United States Patent [19]

Forde

[11] 4,100,871

[45] Jul. 18, 1978

[54] RESCUE APPARATUS FOR SUBMERGED VESSELS

[76] Inventor: Arnold Forde, 1801 N. Ventura Rd. #65, Oxnard, Calif. 93030

[21] Appl. No.: 785,428

[22] Filed: Apr. 7, 1977

[51] Int. Cl.[2] ..... B63C 7/00

[52] U.S. Cl. ..... 114/51; 114/16.4

[58] Field of Search ..... 114/16 R, 16.4, 16.6, 114/44, 45, 46, 49, 50, 51, 61, 258–263

[56] References Cited

U.S. PATENT DOCUMENTS

| | | | |
|---|---|---|---|
| 1,328,014 | 1/1920 | Phillips | 114/51 |
| 1,582,130 | 4/1926 | Currey | 114/51 |
| 2,561,926 | 7/1951 | Jamison | 114/51 |
| 3,807,336 | 4/1974 | Briggs | 114/51 |

*Primary Examiner*—Trygve M. Blix
*Assistant Examiner*—D. W. Keen

[57] ABSTRACT

Apparatus for raising submerged vessels including a ship having a dual hull section. A winch attached to cables threaded through support structures are provided on the dual hull section. Vessel support bars are mounted onto each the dual hulls and are adapted to be swung under the submerged vessel when it is raised to a position between the two hulls so that the raised vessel is retained in position between the two hulls.

4 Claims, 3 Drawing Figures

Fig. 1.
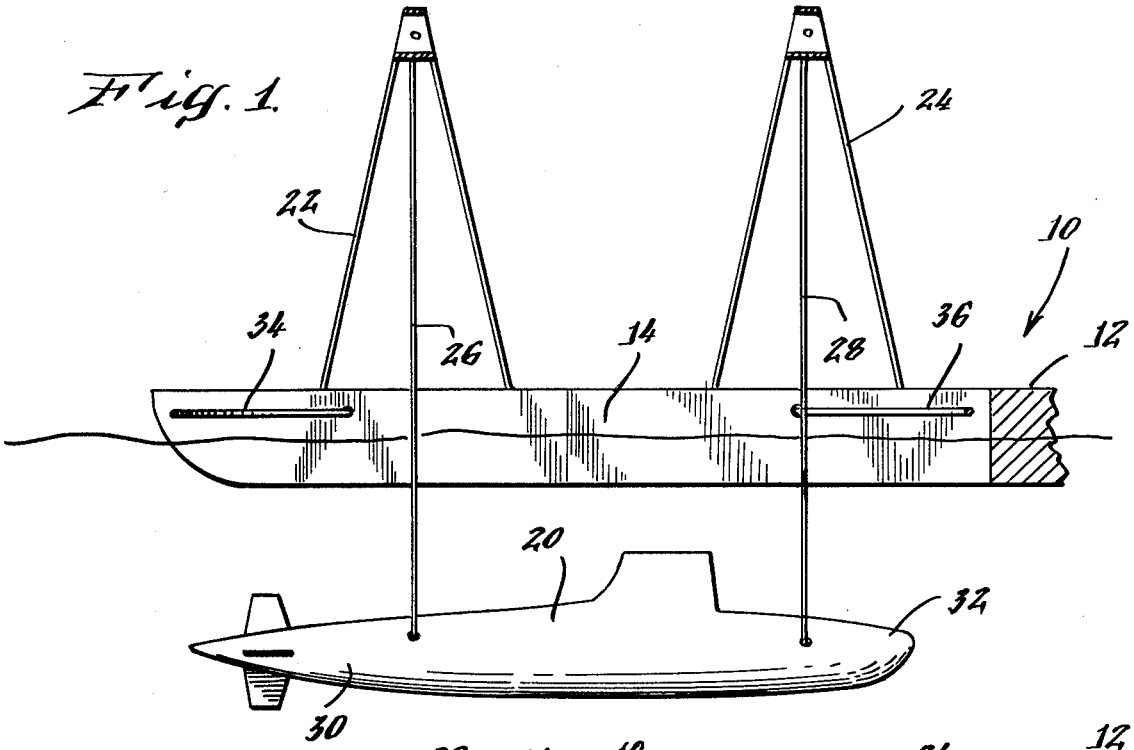
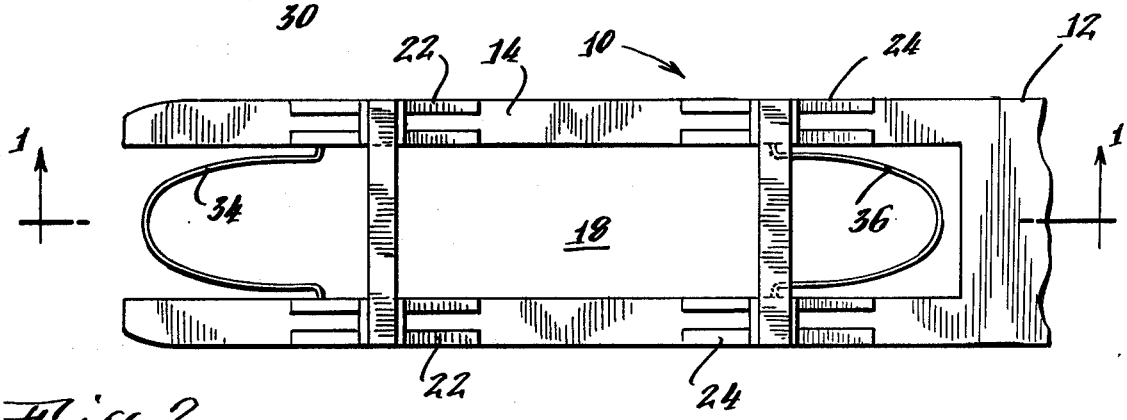
Fig. 2.
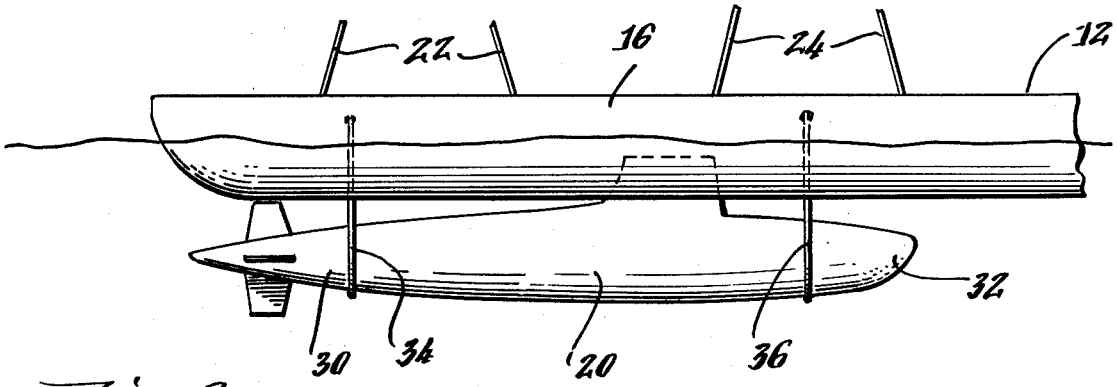
Fig. 3.

RESCUE APPARATUS FOR SUBMERGED VESSELS

PRIOR ART

The following U.S. Pat. Nos. are considered pertinent:

Des. 162,267,
Des. 195,798,
Des. 200,506,
1,733,436,
1,740,532,
2,169,630,
2,329,430,
3,044,812 and
3,797,433.

BACKGROUND OF THE INVENTION

Heretofore, it has been difficult, if not impossible, to recover submerged vessels such as submarines which may contain a crew.

It is common practice to attempt to rescue a trapped crew individually by means of a container which is transported between the floating mother ship and the submerged vessel. However, there has been little or no serious effect in recovering the submerged ship intact together with a contained crew.

SUMMARY OF THE INVENTION

In accordance with this invention, an apparatus is provided for recovering a submerged vessel intact and securing it in a floating position so that it can be transported to a desired location. The apparatus includes a floating "mother" ship having a dual hull section. Support structures are positioned on the dual hull section to support cables attached, at one end, to a winch and at the other end, to the submerged vessel. Two support bars extend between the two hulls. The bars are pivotally mounted so that they can swing into a horizontal position to permit the submerged ship to be lifted between the two hulls. After the submerged vessel is positioned between the two hulls, the bars are pivoted to neutral position under the lifted vessel thereby to support the vessel near the water surface.

BRIEF DESCRIPTION OF THE DRAWINGS

FIG. 1 is a side view of the apparatus of this invention taken along line 1—1 of FIG. 2.

FIG. 2 is a top view of the apparatus of this invention.

FIG. 3 is a side view showing the elevated vessel in place near the water surface.

DETAILED DESCRIPTION OF THE PREFERRED EMBODIMENTS

Referring to the figures, the vessel lifting apparatus 10 a main ship section 12 to which is attached two spaced-apart hulls 14 and 16 to form an area 18 into which a submerged vessel 20 can be positioned. Two derricks 22 and 24 are secured to the hulls 14 and 16 to support cables 26 and 28 respectively which extend downwardly between hulls 14 and 16. The cables 26 and 28 are attached to the stern section 30 and bow section 32 respectively. After the cables 26 and 28 are attached to vessel 20, conventional winches (not shown) are actuated to wind cables 26 and 28 thereby to lift vessel 20. While vessel 20 is being lifted, vessel support bars 34 and 36 are positioned in a generally horizontal position. After vessel 20 has been lifted into area 18 between hulls 16 and 18, support bars 34 and 36 are pivoted to a generally vertical position so that they extend under and support the ship 20. After the support bars 34 and 36 are vertically positioned, vessel 20 is lowered by cables 26 and 28 onto the support bars 34 and 36. When so positioned, the vessel 20 can be transported by the main ship 12 to any desired location.

I claim:

1. Apparatus for positioning a submerged vessel near the surface of a water body which comprises a ship having two integral hull sections extending generally parallel to each other to define an area between said hulls, derrick means including winch and cable means attached to said hulls for lifting said submerged vessel into said area, and at least two U-shaped vessel support bars each extending across said area and pivotally mounted at opposiing ends to each hull for rotation in a direction transverse to the longitudinal axis of said hulls.

2. The apparatus of claim 1 wherein said support bars are shaped to generally conform to the shape of the hull of the submerged vessel.

3. The apparatus of claim 1 wherein said area corresponds to the size of said submerged vessel.

4. The apparatus of claim 1 wherein said derrick means are located at fore and aft positions of said hulls.

* * * * *